US005222659A

United States Patent [19]

Peters

[11] Patent Number: 5,222,659

[45] Date of Patent: Jun. 29, 1993

[54] COMMODITY PARTITION

[75] Inventor: Charles L. Peters, Lake Tahoe, Nebr.

[73] Assignee: Jefferson Snapfit Corporation, St. Louis, Mo.

[21] Appl. No.: 856,343

[22] Filed: Mar. 23, 1992

[51] Int. Cl.[5] ..... B65D 25/04

[52] U.S. Cl. ..... 229/120.29; 229/120.06; 229/120.31

[58] Field of Search ..... 229/120.06, 120.29, 229/120.31, 120.36, 120.38; 217/7, 8, 10

[56] References Cited

U.S. PATENT DOCUMENTS

| | | | |
|---|---|---|---|
| 2,494,437 | 1/1950 | George et al. | 229/120.31 |
| 2,549,799 | 4/1950 | George | 229/120.31 |
| 2,549,800 | 4/1950 | George | 229/120.31 |
| 2,549,801 | 4/1950 | George | 229/120.31 |
| 2,549,802 | 4/1950 | George | 229/120.31 |
| 3,253,763 | 5/1966 | Henderson | 229/120.29 |
| 3,511,404 | 5/1970 | Pearson | 229/120.31 |
| 3,580,471 | 5/1971 | Burke et al. | 228/120.31 |
| 3,843,039 | 10/1974 | Brown et al. | 229/120.31 |
| 4,103,818 | 8/1978 | Raubenheimer | 229/120.36 |
| 4,621,764 | 11/1986 | Ragon | 229/120.31 |

*Primary Examiner*—Allan N. Shoap
*Assistant Examiner*—Christopher McDonald
*Attorney, Agent, or Firm*—Paul M. Denk

[57] ABSTRACT

A partition (10) installable in a container (X) for dividing its interior into a plurality of cells (C1–C12), more or less. The partition includes a first panel (12) having at least one score, crease or fold (14) therein by which the panel can be folded. The first panel may include a pair of panels having contiguous edges about which they pivot with respect to each other, in a manner similar to said folded first panel. The partition also includes second and third panels (20, 22) which are attachable to the first identified panel(s) at the fold(s), or edge separation. These latter panels have interfitting tabs (**26*a*, 26*b*), that interfit intermediate each other. The second panel is attached to a sidewall of the first panel on one side of the fold and the third panel is attached to the sidewall on the other side of the fold. The panels move apart when the first panel is folded at the crease thereby to create the walls of the cells. Each tab has an inner segment (28) adjacent the end of the panel, an intermediate segment (30), and an outer segment (32**). The inner and outer tab segments taper along their lengths; while, the intermediate segment has a constant width to provide a pivot shoulder between adjacent tabs. As a result, the only contact between the second and third panels, when the first panel is folded, is at the intermediate shoulder segments of adjoining tabs. Adjacent interfitted tabs may be slightly spaced from each other for clearance.

23 Claims, 3 Drawing Sheets

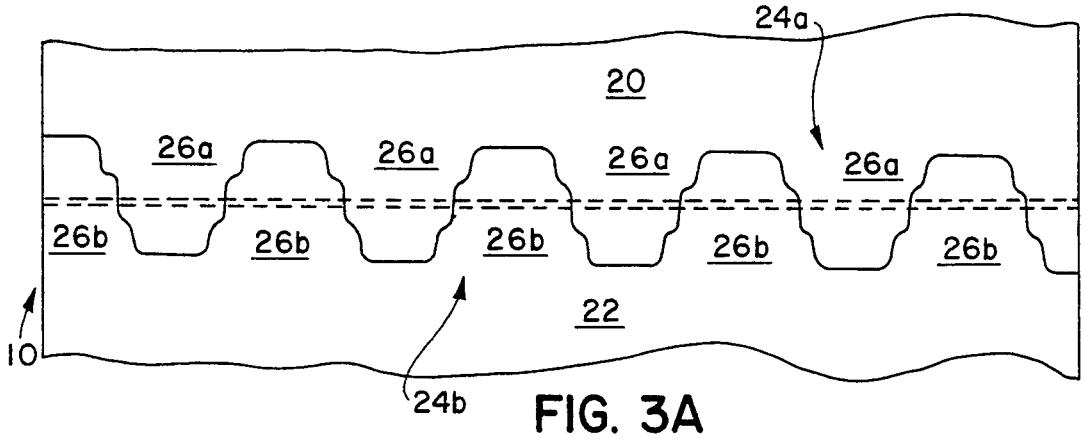
FIG. 3A
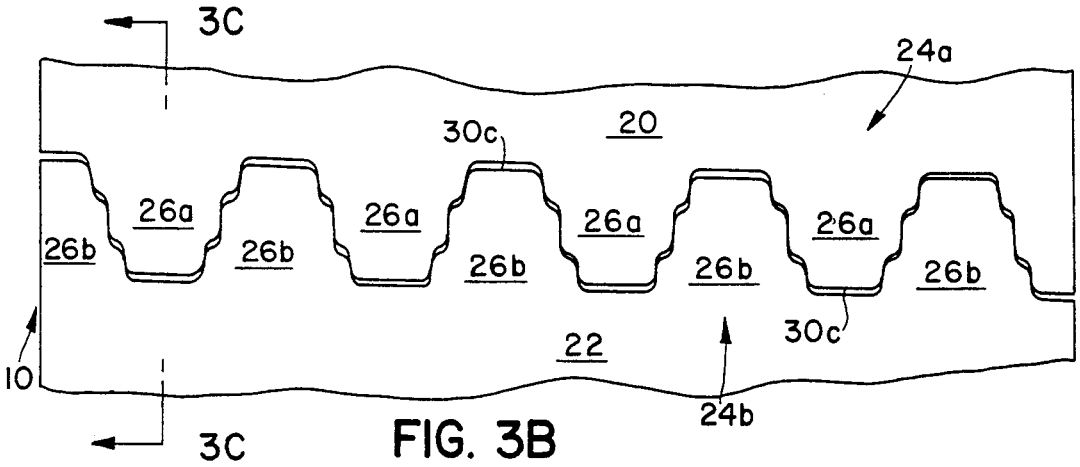
FIG. 3B
FIG. 4
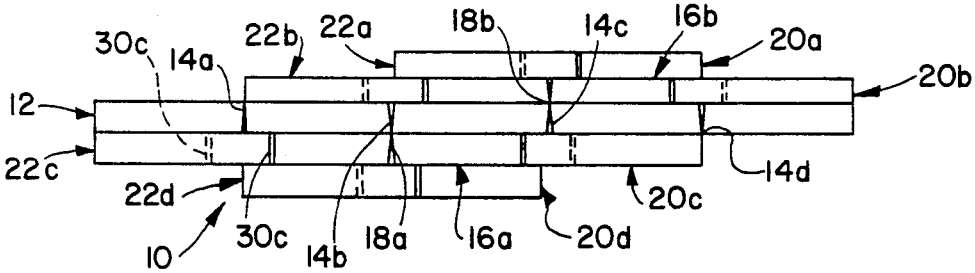
FIG. 7
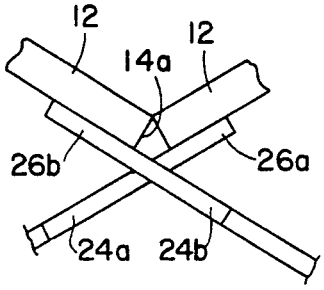
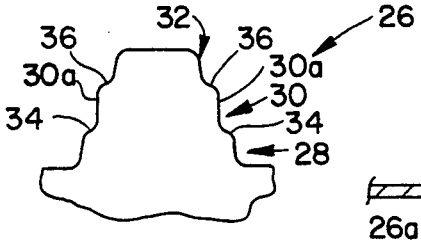
FIG. 6
FIG. 3C
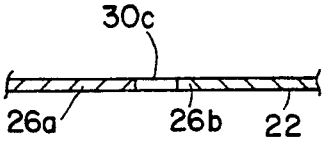

COMMODITY PARTITION

BACKGROUND OF THE INVENTION

This invention relates to partitions for use in a container such as a carton, or a box, or the like, and more particularly, to an improved partition for use in the container to separate commodities placed therein.

Heretofore, there have been numerous attempts to create partitions for use in boxes or similar containers to facilitate the shipping and storage of articles such as glassware, etc., which is shipped in bulk quantities, and whose size, fragility, and similar factors make it impractical to transport in non-compartmentalized containers. Representative examples of such partitions and dividers are shown in U.S. Pat. Nos. 4,094,454 to Snyder, 4,007,830 to Calvert, 3,511,404 to Pearson, 2,743,836 to Roberts, 3,253,763 to Henderson, 2,854,103 to Kruger, 2,549,800 and 2,549,799 to George, 2,494,437 to George et al., and 1,494,962 to Sheffner. As is shown in various of these patents, a partition is made by interlocking lengthwise and crosswise members or panels. This interlocking is accomplished by use of tabs, folded portions of a panel, etc., which fit into a slot or slit in another panel. It has been a particular problem with such constructions that the portion of the tabs or folds tear during forming of the divider, or in use. This can lead to a failure in the separation between cells and allow the articles to shift about. This leads to more breakage or parts damage and, as a result, increases shipping and replacement costs.

More specifically, in the various prior art patents disclosed, U.S. Pat. No. 4,094,454, shows a partitioned container embodying a removable partition, within a box, with the partition having vertical edge portions, and incorporates movement resisting substance that is adhered to at least a portion of the partition vertical edge portions, to resist slipping of the partition within its carton.

The patent to Sheffner, U.S. Pat. No. 1,494,962, shows a sectional partition, with non-interacting segments, for use in a container, and it appears that each segment of the partition particularly at their points of intersection, are fabricated of multi-wound configuration, while being fabricated to a firmly interlocked configuration.

The patent to George, et al, U.S. Pat. No. 2,494,437, shows a process of manufacturing collapsible cellular container partitions. The particular partition shown is apparently fabricated of a pair of webs, which are cut longitudinally along a zig-zag configuration, that are interfitted by alternating tongues, so that the partition can be collapsed, as shown in the patent.

The patent to George, U.S. Pat. No. 2,549,799, discloses a collapsible cellular partition for containers, and this partition is a little more complex in structure, as noted, and is apparently made up of four different partition sections, as identified, which are interlinked together by means of their various tongues, to provide for erection of the partition during usage, but which also can be collapsed.

Another cellular partition is shown in the patent to George, U.S. Pat. No. 2,549,800, which discloses how its panels may be interlinked together by means of tongues, to provide a cellular partition that may be located within a collapsible container, and collapsed in uniformity therewith.

The patent to Roberts, U.S. Pat. No. 2,743,836, shows a metal partition for milk container, which apparently is made up of either two angulated sections, or three sections, and this type of partition, though, is not otherwise pertinent to the subject matter of this invention, other than showing their multiple configuration, as disclosed in its FIG. 4.

The patent to Pearson, U.S. Pat. No. 3,511,404, shows a series of interlinking partition walls, which apparently interconnect together by means of cooperating slots, as noted, and which partition can then be stacked to flat, in the manner as disclosed.

The patent to Kruger, U.S. Pat. No. 2,854,103, shows a type of light-shielding grid, but this is not overly pertinent to the subject matter of this current disclosure.

The patent to Henderson, U.S. Pat. No. 3,253,763, shows a form of cross partition, which has little tab sections, as noted, which extend through scores, to provide the type of cross partition as shown in the patent.

There is a patent to Calvert, U.S. Pat. No. 4,007,830, upon an article carrier partition insert, which shows a form of divider, as a partition insert for use within a beverage carton, and which is collapsible with the carton, during its erection, for usage and holding a variety of beverage containers.

Also, a patent to Ikelheimer, U.S. Pat. No. 3,491,909, shows another form of partition.

SUMMARY OF THE INVENTION

Among the several objects of the present invention may be noted the provision of a partition for use in a carton or box to divide the container into individual cells, and to increase the structural strength of containers, in which articles are placed for shipment and storage; the provision of such a partition in which the various panels are interconnected; the provision of such a partition which can be folded substantially flat for shipment but readily unfolded for installation in a container; the provision of such a partition utilizing various combinations of panels to produce 4, 6, 9, 12, 16, and 24 cells, for example, in the container; the provision of such a partition in which the various panels are interfitted so they readily move apart when the partition is opened up for installation into a container; the provision of such a partition utilizing tabs formed to prevent tearing or interference as the partition is opened and closed; and, the provision of such a partition which is reusable.

More specifically, it is inherent in the structure of the partition of this invention that the various edges of the partitions, which are interfitted or interdigitated together, may be formed of separate panels, such as, for example, a pair of panels that abut edge to edge, with their integral extending portions interfitting together, or a pair of such panels may be simply a unified panel, which is folded along the crease area, and with their interdigitating extensions projecting for connecting with cooperating panels to form the container, or even further embodied within the structure of this invention, such panels may simply be a unified panel which is scored, along its fold area, and with the extensions projecting therefrom for formation into the assembled partition of this invention.

In accordance with the invention, generally stated, a partition is installable in a container for dividing its interior into a plurality of cells, and to increase the structural strength of the container to prevent crushing when used for shipment or storage. The partition includes a first panel having at least one score, crease, fold, or separation therein, as aforesaid, by which the panel can be folded, or left integrally coextensively along its fold, to enhance the partition's strength, as previously explained. The partition also includes second and third panels which are attachable to the first panel at the fold. These latter panels have interfitting tabs. The second panel is attached to a sidewall of the first panel on one side of the fold and the third panel is attached to the sidewall on the other side of the fold, such that the panels, when folded, interact and move apart for inherent clearance purposes. The panels move apart when the first panel is folded at the crease or score thereby to create the walls of the cells. Each tab has an inner segment adjacent the end of the panel, an intermediate segment, and an outer segment. The inner and outer tab segments taper along their lengths; while, the intermediate segment has a constant width. As a result, the only contact between the second and third panels, when the first panel is folded, is at the intermediate segments of adjoining tabs.

Other objects and features will be in part apparent and in part pointed out hereinafter.

BRIEF DESCRIPTION OF THE DRAWINGS

FIGS. 3*a* and 3*b* illustrate a tab construction for joining panels of the divider together, the panels being in an unflexed position in FIG. 3*a* and a flexed position in FIG. 3*b;*

FIG. 3C illustrates the space between adjacent panel tabs when they are interdigitated together when joined to the first panel;

FIG. 4 is an end view of the partition in its compacted position;

FIG. 6 is an elevational view of a tab formed on the edge of a panel used in the partition; and, FIG. 7 is an end view of one intersection of the divider.

Corresponding reference characters indicate corresponding parts throughout the drawings.

DESCRIPTION OF A PREFERRED EMBODIMENT

Figure 1:
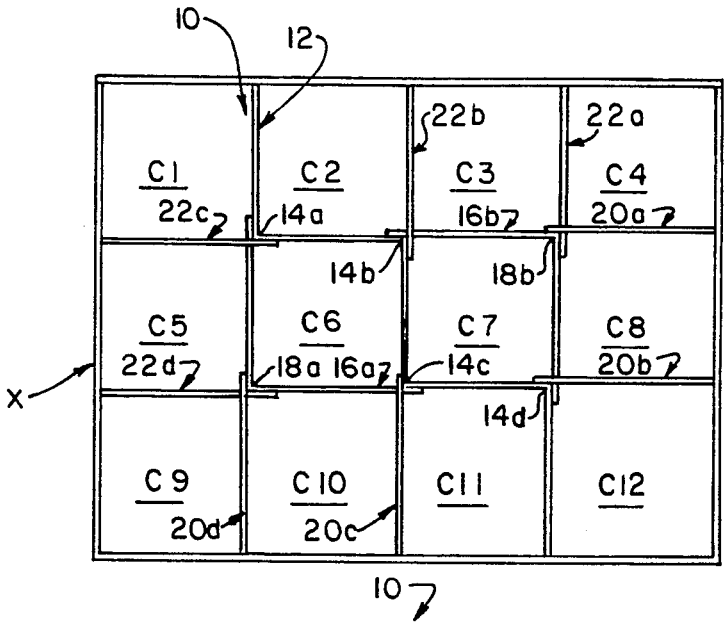
FIG. 1 is a top plan view of a container with a partition of the present invention installed therein.
Figure 2A:
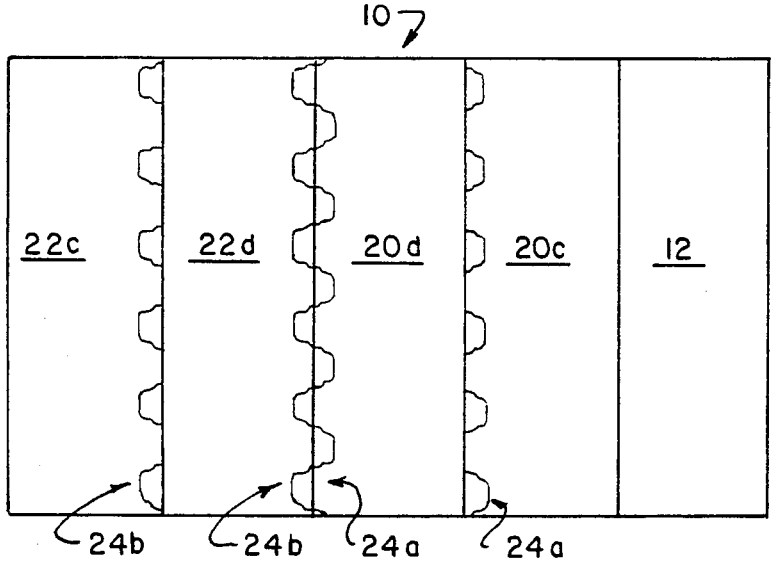
FIGS. 2*a* and 2*b* are respective opposite side views of the partition in a compact, storage position.
Figure 2B:
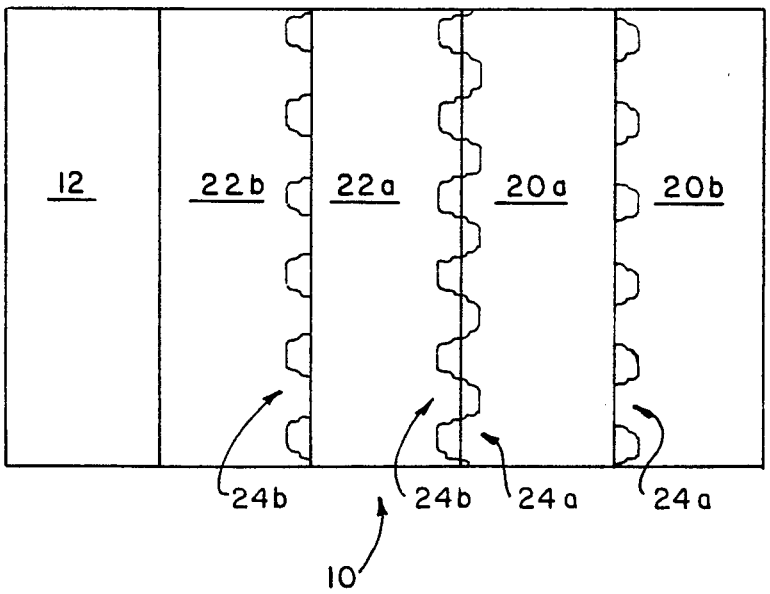

Referring to the drawings, a partition 10 of the present invention is installable in a container X. When installed, the partition divides the container into a plurality of cells such as the cells C1–C12 indicated in FIG. 1. After installation, articles, not shown, can be placed in the cells for storage or transport. While the partition 10 of FIG. 1 divides the interior of the container into 12 cells, it will be understood that the partition can be constructed to form more, or fewer, cells. As particularly shown in FIGS. 5*a*–5*c*, 4, 6, and 9 cell arrangements can be formed, in addition to other variations. For example, partitions forming 16, 20, 24, etc. cells can be formed in accordance with the teachings of the present invention.

Referring to FIG. 1, partition 10 is comprised of a first panel 12. This panel is rectangular in shape and has at least one fold, crease, or score 14 extending perpendicular to the top edge of the panel. Actually, as shown in FIGS. 1 and 4, panel 12 has four such folds (14*a*–14*d* respectively), which may be, but do not necessarily have to be, equidistantly spaced along the length of the panel. Each fold is on the opposite side of the panel from the its adjacent folds. This permits the panel to be folded in the opposite direction at each fold. Thus, the panel can be formed into the "stair-step" form shown in the plan view of the partition of FIG. 1. Partition 10 further includes panels 16*a* and 16*b*. These are similar to panel 12 in that each panel 16 is rectangular in shape and has a fold, crease or score (18*a*, 18*b* respectively) extending perpendicular to the edge of the panel. Whereas panel 12 has four folds dividing it into five sections, each panel 16 has only one fold to divide it into two sections. As shown in FIG. 4, the panels are positioned such that when partition 10 is in its flat, compact state, fold 18*a* of one panel 16*a* is directly opposite fold 14*b*; while the fold 18*b* of panel 16*b* is directly opposite crease 14*c*. Thus the panels are arranged on opposite sides of panel 12 and are offset from one another.

Besides the above, partition 10 also generally includes a panel 20 and a panel 22. As seen in FIGS. 1 and 4, partition 10 includes four panels 20 (panels 20*a*–20*d* respectively) and four panels 22 (22*a*–22*d* respectively). All of the panels 20, and all of the panels 22, are identical in length and width, and the panels are designed for attachment to one of the sections of either panel 12, or panels 16*a*, 16*b*. Obviously, while the preferred embodiment may show panels being of uniform dimensions, it is just as likely that the separate panels, forming parallel side walls for each cell of the partition, may be of differing widths, or even lengths, for the purpose of forming cellular openings that are more rectangular in dimension, rather than squared, as shown in FIG. 1. This is just an example of how variation may be made to the structure of the partition, to accommodate the differing nature of its application and usage. For this purpose, the panels 20 include a means indicated generally 24*a* for attachment to the panel sections, and the panels 22 include a means of attachment indicated generally 24*b*. The respective means 24*a*, 24*b* each comprises a series of tabs (26*a*, 26*b* respectively) formed on one end of the respective panels. These tabs are so formed that when the partition is in its closed, compacted position, the respective series of tabs interfit or interdigitate as shown in FIG. 3*a*. It will be understood that the configuration of the tabs, as described hereinbelow, is identical for each panel. The tabs formed on the end of one panel are, however, offset with respect to those on the other panel, so the tabs interfit or interdigitate, as aforesaid.

Referring to FIG. 6, each tab has three segments, an inner segment 28, an intermediate segment 30, and an outer segment 32. The inner and outer segments are of the same length; while, the intermediate segment may be the same length, or somewhat longer or shorter. The base of inner segment 28 comprises the point of integral attachment of the tab to the remainder of the panel. From the base to the outer end of this inner segment, the sides of the segment taper inwardly. The width of the intermediate segment is less than the width of the inner segment. Thus, a pair of shoulders 34 are formed at the juncture between these two segments. The intermediate segment differs from the inner segment in that it has a constant width throughout its length. The width of the outer segment is narrower than that of the intermediate segment at the juncture between the two segments. This creates a pair of shoulders 36 at the juncture between these two segments. The shoulders 34 and 36 are generally formed of the same radii. The sides of this outer segment also taper inwardly from the juncture to the outer end of this segment.

When a partition 10 is formed, the lateral centerline of the intermediate section is offset with respect to the fold of the panel 12 (or 16) to which the panel 20 (or 22) is being attached to take into account the material thickness. This alignment is made on the opposite side of the panel from that in which the score is made. Further, the panel 20 is oriented so the outer half of the intermediate segment, and all of the outer segment, lay flat against the sidewall of the panel 12, even after the panel 12 has been folded at the crease. Attachment of the panel 20 to the other panel is made, for example, by applying a glue to that portion of the tab laying against the sidewall of panel 12. The other panel 22 (or 20) is oriented in a similar fashion. Now, however, the outer half of the intermediate segment, and all of the outer segment, of its tabs lay flat against the sidewall of the panel 12, on the opposite side of the crease. This portion of the tabs is also attached to the sidewall of panel 12, as, for example, by gluing.

It will be understood that the panels can be of any convenient material, and can be either of a single or multiple layer of thickness. Further, the partition can be designed for a one-time or for repetitive usage. To facilitate the insertion or retention of the divider into or within a container, the edges of the panels may be coated. In any event, when the partition is opened from its storage position, the only contact between the tabs on panels 20 and 22 is at the intermediate segments 30 of the respective tabs. In fact, the flat portions provided at 30*a*, provide a pivot surface against which the two panels are allowed to pivot with respect to each other, when folded into the erected configuration. Since the panels pivot in opposite directions when the panel 12 is folded at the crease, the movement of the tabs is as shown in FIG. 3*b*, and FIG. 7. But, as further noted in these figures, the panel sections 24*a* and 24*b*, when they are assembled into the usable partition configuration are slightly separated, as can be noted by the gaps 30*c*, so that when the various panels are fabricated into the position as shown in FIG. 4, these gaps will exist between the panel sections, even in the flattened configuration, so that as the panels pivot in opposite directions when the panel 12 is folded at the crease, into the condition of erection, the movement of the tabs will be as shown in FIG. 3*b*, and there will be no binding between tab sections, because of the existence of these clearance gaps 30*c*. As shown therein, the respective series of tabs pivot apart. Since the outer segment 32 of the tabs of the one series fit between the inner segments 28 of the tabs of the other or interfitted series, the tappering shape of the respective tab segments, except for the parallel planar surfaces 30*a*, allows them to freely separate from each other without binding or tearing. The intermediate segments 30 form a pivot about their parallel surfaces, as at 30*a*, as aforesaid, which allows the tabs on the other panel to freely turn, without obstruction. This is also accomplished without binding or tearing of any tabs therein.

Figure 5A:
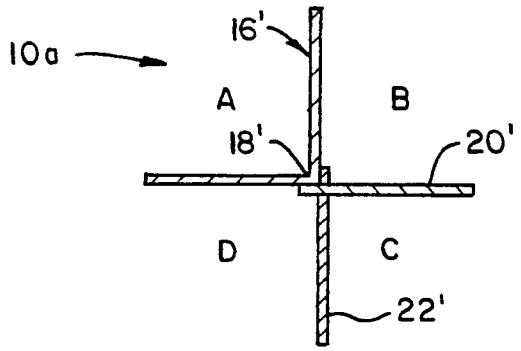
FIGS. 5*a*–5*c* illustrate some possible combinations of panels used in forming the divider to form a divider of 4, 6, and 9 cells respectively.
Figure 5B:
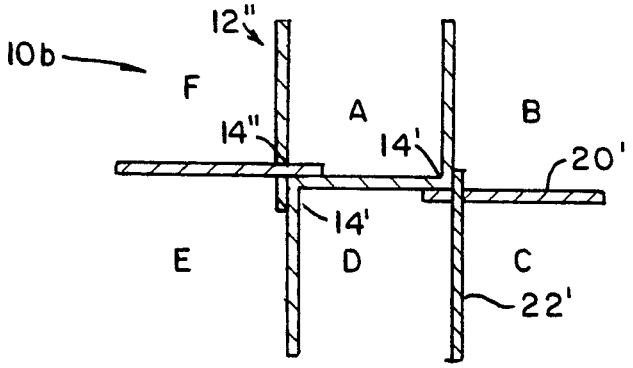
Figure 5C:
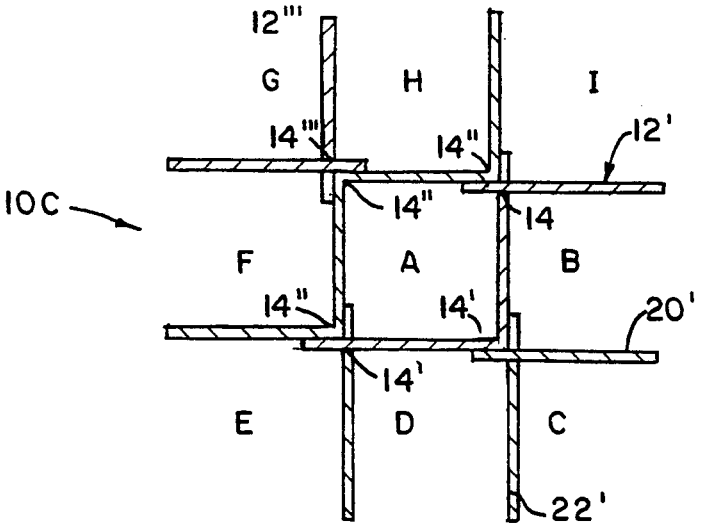

Referring to FIGS. 5*a*–5*c*, there is shown how panels 12 can be used with various combinations of panels 20, 22 and other panels 16 to effect different multi-cell partitions. Thus as shown in FIG. 5*a*, a panel 16' having a single crease 18' can be used with one panel 20' and one panel 22' to form a four-cell partition 10*a* having cells A–D. In FIG. 5*b*, a panel 12' having two creases 14' is used in combination of panels 20', a panel 22'. This combination forms a six-cell partition 10*b* having cells A–F. Lastely, FIG. 5*c* illustrates a nine-cell partition 10*c* employing panels 12', 12'', and 12''', together with panels 20' and 22', and forming cells A–I. It will be understood that other combination can be used to form partitions of 16, 20, 24 cells, etc. These being in addition to the twelve-cell partition 10 of FIG. 1.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A partition fitting into a container for separating the interior of the container into a plurality of cells into each of which an article can be placed, the partition including a first panel having one of a crease, fold, or score therein to facilitate folding of the panel, and at least two additional panels attached to the first panel adjacent the fold and arranged at opposite edges of the fold thereof, the two additional panels moving relative to each other and to the first panel when the first panel is folded at its crease whereby the folded panels comprise walls defining the cells, means connecting said additional panels to said first panel, said connecting means interdigitating said additional panels for their movement relative to each other when said first panel is folded at its crease, fold, or score, the connecting means allowing an opening to form between the additional panels at their connection to said first panel to facilitate their movement relative to each other, said connecting means including a series of spaced apart tabs formed at one end of each of the additional panels and extending outwardly therefrom, the tabs from one of the additional panels interdigitating with the tabs on the other additional panel, one series of the spaced apart tabs formed of a panel is offset with respect to those of the other series of tabs for the other panel to provide for their interfitting, the shape of the tabs being such that the additional panels can freely move and not interfere with each other when the first panel is folded, each tab has an inner segment adjacent the end of its panel, and an intermediate segment extending from the outer end of the inner segment, and an outer segment extending from the outer end of the intermediate segment, the shape of the tabs being such that the only contact between the additional panels, when the first said panel is folded, is at the fold, crease or score, said inner and outer tab segments taper along their lengths from their inner to their outer ends, and the intermediate segment has a constant width throughout its length.

2. The partition of claim 1 wherein the width of an intermediate tab segment, at its juncture with the inner tab segment, is less than that of the inner segment at the juncture thereby forming a shoulder on each side of the intermediate segment.

3. The partition of claim 2 wherein the width of the outer tab segment, at its juncture with the intermediate tab segment, is less than that of the intermediate segment at the juncture thereby forming a shoulder on each side of the outer segment.

4. A partition installable in a container for dividing the interior of the container into a plurality of cells, the partition including a first panel having at least one score therein enabling the panel to be folded, and a second and third panel each having means by which the second and third panels are attached to the first panel at the score, the means on the second panel interfitting with the means on the third panel whereby the second panel is attached to the sidewall of the first panel at one edge of the score and the third panel is attached to the sidewall on the other side edge of the score, the second and third panels moving apart when the first panel is folded at the crease to thereby create the walls defining the cells, the attaching means including a series of spaced apart tabs formed at one end of each of the second and third panels and extending outwardly therefrom, the tabs formed on the end of the second panel corresponding in size and shape to, and being offset with respect to, the tabs formed on the end of the third panel so as to interfit therewith, the respective series of tabs allowing an opening to form between the second and third panels to freely move in opposite directions when the first panel is folded and not interfere with each other, each tab has an inner segment adjacent the end of its associated panel, an intermediate segment, and an outer segment, the inner and outer tab segments tapering along their lengths from their inner to their outer ends, and the intermediate segment having a constant width throughout its length, whereby the only contact between the second and third panels, when the first panel is folded, is at the intermediate segments of adjoining tabs.

5. The partition of claim 4 wherein the width of the intermediate segment, at its juncture with the inner segment, is less than that of the inner segment at the juncture, and the width of the outer segment, at its juncture with the intermediate segment, is less than that of the intermediate segment at the juncture, whereby respective shoulders are formed on the inner and intermediate segments.

6. The partition of claim 5 including a plurality of first, second, and third panels arranged to form a multi-cell partition, the number of cells formed being a function of the combination of panels used.

7. A partition fitting into a container for separating the interior of the container into a plurality of cells into each of which an article can be placed, the partition including a first panel having one of a crease, fold, or score therein to facilitate folding of the panel, and at least two additional panels attached to the first panel adjacent the fold and arranged at opposite edges of the fold thereof, the two additional panels moving relative to each other and to the first panel when the first panel is folded at its crease whereby the folded panels comprise walls defining the cells, connecting means attaching said additional panels to said first panel, said connecting means interdigitating said additional panels for their movement relative to each other when said first panel is folded at its crease, fold or score, the connecting means allowing an opening to form between the additional panels at their connection to said first panel to facilitate their movement relative to each other, said connecting means including a series of spaced apart tabs formed at one end of each of the additional panels and extending outwardly therefrom, the tabs from one of the additional panels interdigitating with the tabs of the other additional panel, one series of said spaced apart tabs formed to offset with respect to those of the other series of tabs for the other panel to interfit, the shape of the tabs being such that the additional panels can freely move and not interfere with each other when the first panel is folded, the tabs of both the additional panels being connected to an edge of the first panel adjacent the fold, with the tabs of one of the additional panels being attached to the wall at one edge of the fold and the tabs of the other additional panel being attached to the other edge of the wall at the fold whereby when the first panel is folded about its crease, fold or score, the respective additional panels pivot about the fold in opposite directions, and whereby said tabs of the additional panels connect to the first panel without extending through the folded first panel.

8. The partition of claim 7 wherein each tab has an inner segment adjacent the end of its panel, an intermediate segment extending from the outer end of the inner segment, and an outer segment extending from the outer end of the intermediate segment, the shape of the tabs being such that the only contact between the additional panels, when the first said panel is folded, is at the fold, crease or score.

9. The partition of claim 7 wherein the first panel has a plurality of creases spaced along its length, each crease being on the opposite side of the panel from the adjacent crease for the panel to fold in one direction at one crease and in the opposite direction at the next crease.

10. The partition of claim 9 wherein at least one additional panel is attached to a side of the first said panel at each fold.

11. The partition of claim 10 wherein at least one end of the first panel has a series of spaced apart tabs formed therealong which correspond to the tabs formed on the end of either of the additional panels.

12. The partition of claim 7 including a plurality of first panels and additional panels arranged to form a multi-cell partition, the number of cells formed being a function of the combination of panels used.

13. The partition of claim 7 wherein the first panel has a plurality of scores spaced along its length, each score being on the opposite side of the panel from the adjacent score for the panel to fold in one direction at one score and in an opposite direction at the next score.

14. A partition installable in a container for dividing the interior of the container into a plurality of cells, the partition including a first panel having at least one score therein enabling the panel to be folded, and a second panel and a third panel each having means by which the second and third panels are attached to the first panel at the score, the means on the second panel interfitting with the means on the third panel whereby the second panel is attached to a side wall of the first panel on one side of the score and the third panel is attached to the side wall on the other side of the score, the second and third panels moving apart when the first panel is folded at the crease thereby to create walls defining the cells, the means for attaching the second and third panel to the first panel including a series of spaced apart tabs formed at one end of each of the second and third panels and extending outwardly therefrom, the tabs formed on the end of the second panel corresponding in size and shape to, and being offset with respect thereto, the tabs formed on the end of the third panel so to interdigitate therewith, the respective series of tabs allowing an opening to form between the second and third panels to freely move in opposite directions when the first panel is folded and not interfere with each other, and said tabs connecting to the first panel without extending through the first panel at its score thereof.

15. The partition of claim 14 wherein each tab has at least two segments, an outer segment and an inner segment, the inner segment providing a pivotal shoulder about which the adjacent tabs may freely turn, while aligned tabs and interfitting means on aligned panels have a gap therein to prevent binding between panels when erected.

16. A partition interfitted into a container for separating the interior of the container into a plurality of cells into each of which an article can be placed, the partition including a first pair of panels having adjacent and contiguous edges, formed at a separation between said panels therein to facilitate pivoting of the said first pair of panels with respect to each other, and at least two additional panels attached to the first pair of panels adjacent the contiguous panel edges, the two additional panels moving relative to each other and to the first pair of panels when the first of panels are pivoted at its contiguous edges whereby the panels comprise walls defining cells of the partition, connecting means attaching said additional panels to select of said first pair of panels, said connecting means interdigitating said additional panels for their movement relative to each other when said first pair of panels are folded at their contiguous edges, the connecting means allowing an opening to form between the additional panels at their connection to select of said first pair of panels to facilitate their movement relative to each other, said connecting means including a series of spaced apart tabs formed at one edge of each of the additional panels and extending outwardly therefrom, the tabs from one of the additional panels interdigitating with the tabs on the other additional panel, and said tabs of the additional panels connecting with the first pair of panels without extending therethrough.

17. The invention of claim 16, wheren said partition forming into cells when the two additional panels are folded relative to the folding of the first pair of panels, and whereby said various panels are arranged into flattened contiguity when said partition is collapsed during nonusage.

18. A partition fitting into a container for separating the interior of the container into a plurality of cells, the partition including a first panel having at least one of a crease, fold, or score therein to facilitate folding of the panel, and at least two additional panels attached to the first panel adjacent the fold and arranged at opposite edges of the fold thereof, the two additional panels moving relative to each other and to the first panel when the first panel is folded at its crease whereby the folded panels comprise walls defining the cells, means connecting said additional panels to said first panel, said means including a series of spaced apart tabs formed at an end of the said additional panels and extending outwardly therefrom, at least one tab of one of the additional panels interdigitating with at least one tab of the other of said additional panel, the interdigitated additional panels being moved apart laterally a small distance so as to pivot freely about the crease and not interfere with each other when the first panel is folded.

19. The invention of claim 18 and wherein the shape of the tabs being such that the only contact between the additional panels when the first panel is folded is at the fold, crease, or score.

20. The invention of claim 18 and wherein said tabs of the additional panels connecting with the first panel without extending therethrough.

21. A partition fitting into a container for separating the interior of the container into a plurality of cells, the partition including a first panel having at least one of a crease, fold or score therein to facilitate the folding of the panel, and at least two additional panels attached to the first panel adjacent the fold and arranged at opposite edges of the fold thereof, the two additional panels moving relative to each other and to the first panel when the first panel is folded at its crease whereby the folded panels comprise walls defining the cells, means connecting said additional panels to said first panel, said means including a series of spaced apart tabs formed at an end of the said additional panels and extending outwardly therefrom, at least one tab of one of the additional panels interdigitating with at least one tab of the other of said additional panels, whereby said tabs of the additional panels connecting with the first panel without extending through the first said panel.

22. The invention of claim 21 and wherein said interdigitated additional panels being moved apart laterally a short distance so as to pivot freely about the crease of the first panel without interference.

23. The invention of claim 21 and wherein the shape of the tabs being such that the only contact between the additional panels when the first panel is folded is at the fold, crease, or score of the said first panel.

* * * * *

UNITED STATES PATENT AND TRADEMARK OFFICE

CERTIFICATE OF CORRECTION

PATENT NO. : 5,222,659

DATED : June 29, 1993

INVENTOR(S) : Charles L. Peters,

It is certified that error appears in the above-identified patent and that said Letters Patent is hereby corrected as shown below:

Title page, item [75]
Please change inventor's address from Lake Tahoe, "Nebr." to ---Nev.---.

Title page, item [73]
Please change Assignee's name from "Jefferson Snapfit Corporation" to ---Jefferson Smurfit Corporation---.

Signed and Sealed this

Twenty-second Day of February, 1994

*Attest:*

Bruce Lehman

BRUCE LEHMAN

*Attesting Officer*

*Commissioner of Patents and Trademarks*